US005321953A

United States Patent [19]

Olson, Jr.

[11] Patent Number: 5,321,953

[45] Date of Patent: Jun. 21, 1994

[54] CRYOGENIC RECTIFICATION SYSTEM WITH PREPURIFIER FEED CHILLER

[75] Inventor: Raymond R. Olson, Jr., Williamsville, N.Y.

[73] Assignee: Praxair Technology, Inc., Danbury, Conn.

[21] Appl. No.: 58,820

[22] Filed: May 10, 1993

[51] Int. Cl.[5] ..... F25J 3/00

[52] U.S. Cl. ..... 62/18; 62/24; 62/39

[58] Field of Search ..... 62/24, 39, 18

[56] References Cited

U.S. PATENT DOCUMENTS

| | | | |
|---|---|---|---|
| 3,967,464 | 7/1976 | Cormier et al. | 62/39 |
| 4,557,735 | 12/1985 | Pike | 55/26 |
| 4,715,873 | 12/1987 | Auvil et al. | 62/38 |
| 4,806,136 | 2/1989 | Kiersz et al. | 62/18 |
| 4,936,099 | 6/1990 | Woodward et al. | 62/39 |
| 5,036,672 | 8/1991 | Rottmann | 62/39 |
| 5,074,898 | 12/1991 | Cheung | 62/38 |
| 5,081,845 | 1/1992 | Allam et al. | 62/24 |
| 5,098,457 | 3/1992 | Cheung et al. | 62/24 |
| 5,146,756 | 9/1992 | Lavin | 62/24 |
| 5,163,296 | 11/1992 | Ziemer et al. | 62/24 |
| 5,197,296 | 3/1993 | Prosser et al. | 62/39 |
| 5,207,067 | 5/1993 | Acharya | 62/24 |

OTHER PUBLICATIONS

H. Cheung et al., "Efficiently Produce Ultra-High Purity Nitrogen On-Site", Chemical Engineering Progress, Oct., 1991.

T. Hardenburger, "Producing Nitrogen At The Point Of Use", Chemical Engineering, Oct., 1992, pp. 136-146.

*Primary Examiner*—Ronald C. Capossela

*Attorney, Agent, or Firm*—Stanley Ktorides

[57] ABSTRACT

A cryogenic rectification system wherein excess pressurized fluid produced in a cryogenic rectification plant is turboexpanded and used to chill feed prior to passing the feed through a prepurifier for removal of at least some of the high boiling component of the feed.

9 Claims, 2 Drawing Sheets

CRYOGENIC RECTIFICATION SYSTEM WITH PREPURIFIER FEED CHILLER

TECHNICAL FIELD

This invention relates generally to cryogenic rectification and in particular to the processing of the feed passed into the cryogenic rectification.

BACKGROUND ART

Feed which undergoes cryogenic rectification must be first cleaned of high boiling impurities because such impurities will freeze at the cryogenic temperatures thus burdening the separation.

In the cryogenic separation of feed air for example, the feed air is cleaned of high boiling impurities such as water vapor, carbon dioxide and hydrocarbons by passage through a prepurifier such as a molecular sieve adsorption unit.

The prepurification of the feed is carried out more efficiently if the feed is chilled prior to prepurification. Chilling the feed condenses out water, which reduces the quantity of water adsorbed by the prepurifer. This reduces the quantity of the adsorbent required and also reduces the regeneration energy requirements.

Generally, the chilling of the feed prior to the prepurificaton is carried out using a mechanical chiller or other energy consuming piece of equipment to chill or refrigerate the feed. This contributes significantly to the operating costs of the cryogenic rectification inasmuch as the entire feed must undergo the chilling.

Accordingly, it is an object of this invention to provide a cryogenic rectification system wherein cooling or chilling the feed is carried out in a more efficient manner compared with conventional cryogenic rectification systems.

SUMMARY OF THE INVENTION

The above and other objects which will become apparent to one skilled in the art upon a reading of this disclosure are attained by the present invention, one aspect of which is:

A method for carrying out cryogenic rectification comprising:

(A) cooling feed air and thereafter prepurifying the cooled feed air;

(B) passing prepurified feed air into a cryogenic rectification plant and separating the prepurified feed air within the cryogenic rectification plant into nitrogen-richer fluid and oxygen-richer fluid;

(C) withdrawing nitrogen-richer fluid from the cryogenic rectification plant and passing withdrawn nitrogen-richer fluid in indirect heat exchange with feed air for cooling the feed air prior to prepurification; and (D) turboexpanding at least a portion of the withdrawn nitrogen-richer fluid and passing turboexpanded nitrogen-richer fluid in indirect heat exchange with feed air for cooling the feed air prior to prepurification.

Another aspect of the invention is:

Apparatus for carrying out cryogenic rectification comprising:

(A) a prepurifier feed chiller, a prepurifier, and means for passing feed through the prepurifier feed chiller and from the prepurifier feed chiller to the prepurifier;

(B) a cryogenic rectification plant and means for passing feed from the prepurifier into the cryogenic rectification plant;

(C) means for withdrawing fluid from the cryogenic rectification plant, and means for passing withdrawn fluid through said prepurifier feed chiller; and (D) a turboexpander, means for passing at least a portion of the withdrawn fluid through the turboexpander, and means for passing fluid from the turboexpander through said prepurifier feed chiller.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on vapor-liquid contacting elements such as on a series of vertically spaced trays or plates mounted within the column and/or on packing elements which may be structured and/or random packing elements. For a further discussion of distillation columns, see the *Chemical Engineers' Handbook.* Fifth Edition, edited by R. H. Perry and C. H. Chilton, McGraw-Hill Book Company, New York, Section 13, "Distillation", *B. D. Smith, et al.,* page 13-3, *The Continuous Distillation Process.*

As used herein, the term "rectification" or continuous distillation means a separation process that combines successive partial vaporizations and condensations as obtained by a countercurrent treatment of the vapor and liquid phases. Cryogenic rectification is a rectification process carried out, at least in part, at low temperatures, such as at temperatures at or below 150° K. A cryogenic rectification plant comprises one or more columns.

As used herein, the term "indirect heat exchange" means the bringing of two fluid streams into heat exchange relation without any physical contact or intermixing of the fluids with each other.

As used herein, the term "feed air" means a mixture comprising primarily nitrogen and oxygen such as air.

As used herein, the term "turboexpansion" and "turboexpander" mean, respectively, process and apparatus for the flow of high pressure gas through a turbine to reduce the pressure and the temperature of the gas thereby generating refrigeration.

As used herein, the terms "prepurification" and "prepurifier" mean, respectively, process and apparatus for the removal of at least some of the high boiling component from a feed stream.

As used herein, the term "high boiling impurity" means a species in a feed which will solidify at cryogenic rectification conditions.

As used herein, the term "nitrogen-richer" means having a nitrogen concentration which exceeds that of the feed.

As used herein, the term "oxygen-richer" means having an oxygen concentration which exceeds that of the feed.

DETAILED DESCRIPTION

The invention comprises the generation of excess pressurized fluid from a cryogenic rectification plant and the turboexpansion of this excess fluid to produce relatively high level refrigeration. The refrigeration is used to chill the feed upstream of the prepurifier thus effectively recovering the energy of the excess pressurized fluid and eliminating the need for a separate powered chiller or refrigeration unit.

The invention will be described in detail with reference to the drawings and in the context of the cryogenic rectification of feed air.

Figure 1:
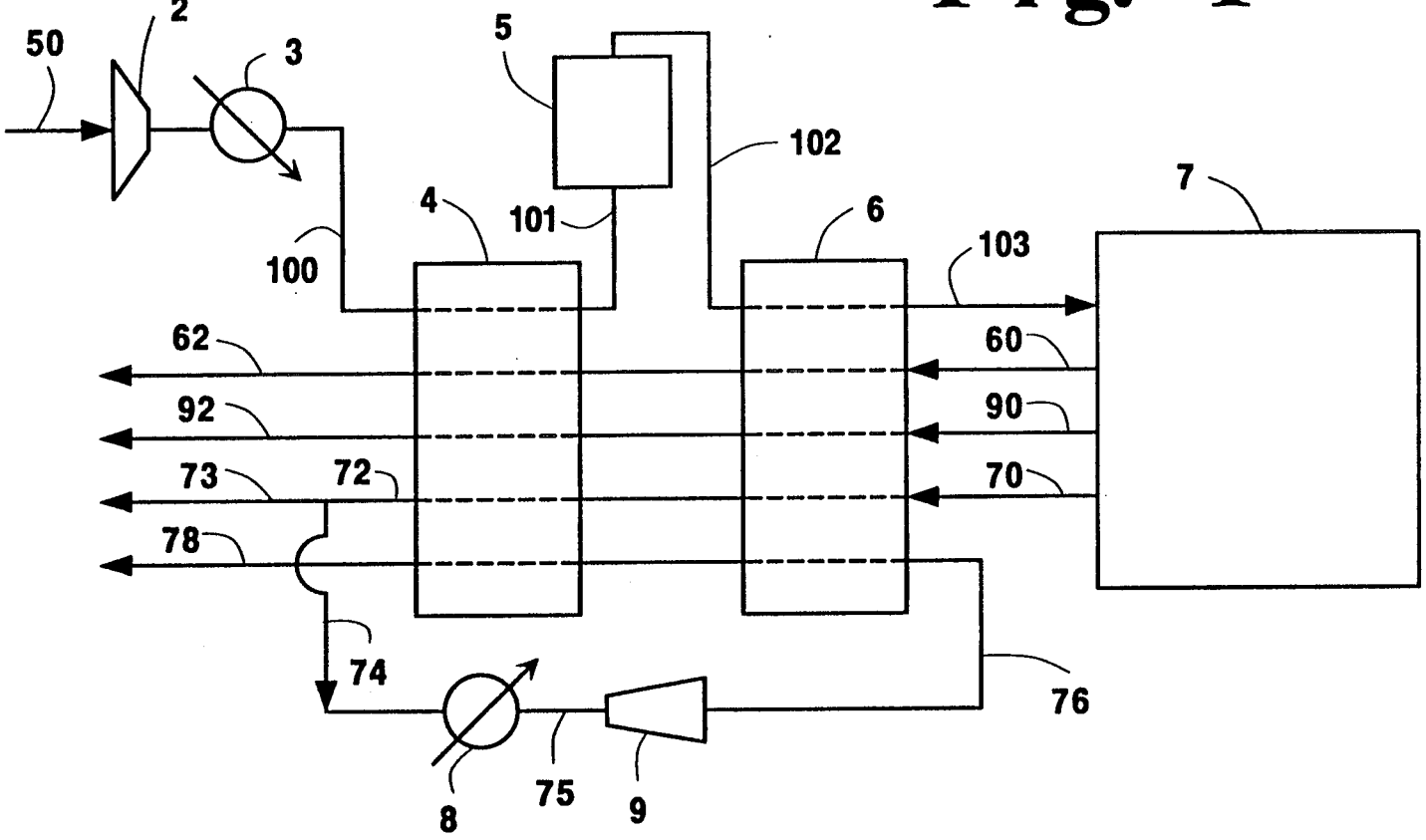
FIG. 1 is a simplified schematic representation of one preferred embodiment of the cryogenic rectification system of this invention.

Referring now to FIG. 1, feed air 50 is compressed by passage through compressor 2 generally to a pressure within the range of from 100 to 450 pounds per square inch absolute. The compressed feed air is cooled by passage through aftercooler 3 to remove heat of compression. The resulting feed air 100 is then cooled by passage through prepurifier feed chiller or heat exchanger 4, generally to a temperature within the range of from 33° F. to 60° F. The cooling of the feed air through chiller unit 4 serves to condense out some water vapor in the feed thus reducing the burden on the downstream prepurification. Thereafter, the cooled feed air 101 is cleaned of high boiling impurities such as water vapor, carbon dioxide and/or some hydrocarbons by passage through prepurifier 5. The prepurifier adsorbent bed may comprise synthetic zeolites or a combination of synthetic zeolites and alumina. The latter is generally preferred. Contaminants are removed from the feed air during the adsorption step. Adsorbed contaminants are desorbed from the bed using a heated regeneration gas which is typically nitrogen.

Prepurified feed air 102 which contains much lower levels of high boiling impurities than does stream 101 is passed from prepurifier 5 to main heat exchanger 6, wherein it is cooled by indirect heat exchange with return streams, and from main heat exchanger 6 as stream 103 into cryogenic rectification plant 7, which is illustrated in FIG. 1 as a representative box. Examples of cryogenic rectification plants which may be used in the practice of this invention include a single column plant, a double column plant, and a double column plant with an argon sidearm column. Those skilled in the art of cryogenic rectification are familiar with these terms and their meanings.

Within cryogenic rectification plant 7, the feed is separated by cryogenic rectification into nitrogen-richer fluid and oxygen-richer fluid. Oxygen-richer fluid is withdrawn from cryogenic rectification plant 7 as stream 60, passed through main heat exchanger 6 and prepurifier feed chiller 4 wherein it is warmed by indirect heat exchange with feed air which is cooled as a result, and is removed from the system, and, if desired, recovered, in stream 62. A first nitrogen-richer fluid may be withdrawn from cryogenic rectification plant 7 as stream 90, passed through main heat exchanger 6 and prepurifier feed chiller 4 wherein it is warmed by indirect heat exchange with feed air which is cooled as a result, and is removed from the system, and, if desired recovered, in stream 92.

A second nitrogen-richer fluid is withdrawn from cryogenic rectification plant 7 as stream 70, passed through main heat exchanger 6 and prepurifier feed chiller 4 wherein it is warmed by indirect heat exchange with feed air which is cooled as a result. In the embodiment illustrated in FIG. 1, resulting stream 72 is divided into two portions, first portion 73 which comprises from 0 to 95 percent of stream 72 and second portion 74 which comprises from 5 to 100 percent of stream 72. Stream 73 is removed from the system and, if desired, recovered. Generally, stream 70 will be at a pressure within the range of from 30 to 110 psia and stream 73 will be at substantially the same pressure less normal pressure drop in the lines.

Stream 74 may, if desired, be heated by passage through heater 8 for more efficient temperature profiles in the heat exchangers. Stream 74 will generally comprise from 5 to 100 percent of the total nitrogen-richer fluid (i.e. the sum of streams 90 and 70) withdrawn from the cryogenic rectification plant. Stream 75 from heater 8 is then passed to turboexpander 9 wherein the pressurized nitrogen-richer fluid is turboexpanded to recover power and produce refrigeration. Power may be recovered by producing electricity in a generator, or by driving a process compressor. Turboexpanded stream 76, which is generally at a pressure within the range of from 15 to 25 psia, is then passed through main heat exchanger 6 wherein it serves to cool feed air and then through prepurifier feed chiller 4 wherein it cools feed air by indirect heat exchange prior to the passage of the feed air to prepurifier 5. Resulting low pressure nitrogen-richer stream 78 is then removed from the system, and, if desired, recovered.

Figure 2:
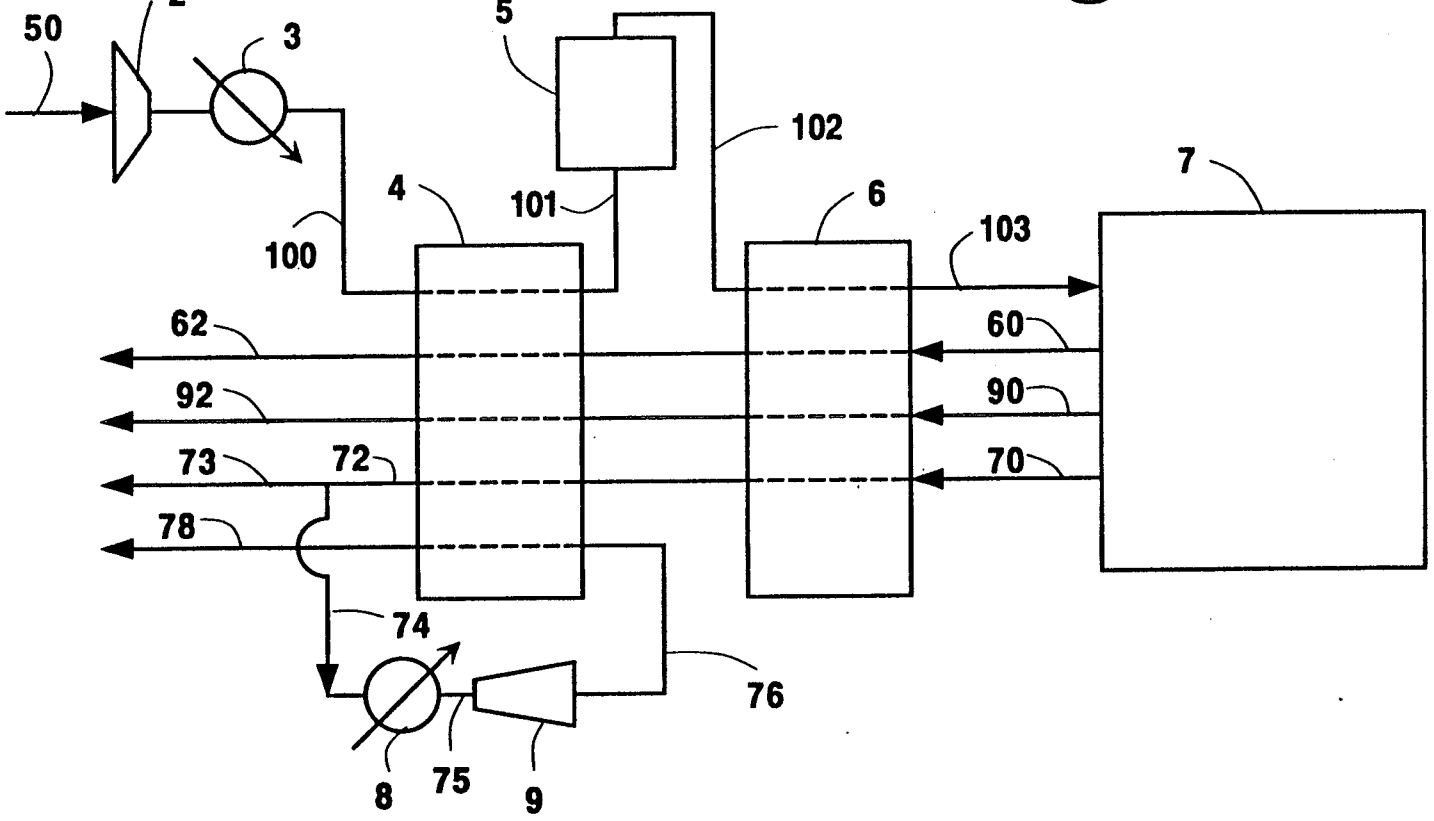
FIG. 2 is a simplified schematic representation of another preferred embodiment of the cryogenic rectification system of this invention.

FIG. 2 illustrates another embodiment of the invention wherein turboexpanded stream 76 does not pass through main heat exchanger 6. The numerals in FIG. 2 correspond to those of FIG. 1. The embodiment illustrated in FIG. 2 is more suitable if the quantity of nitrogen-richer fluid available for turboexpansion is increased. In this embodiment, the nitrogen-richer fluid is turboexpanded to the temperature level of the pressurized streams leaving main heat exchanger 6.

In another embodiment of the invention, the nitrogen-richer fluid which is intended for turboexpansion may be divided into two streams. One of the streams may be turboexpanded to the temperature level suitable for the cold end of main heat exchanger 6, as illustrated in FIG. 1, and the other stream may be turboexpanded through a separate turboexpander to a temperature suitable for the cold end of prepurifier feed chiller 4, as illustrated in FIG. 2.

Generally, in the practice of this invention, the flowrate of the turboexpanded fluid passed in indirect heat exchange with feed air for cooling the feed air prior to prepurification comprises from 4 to 80 percent of the flowrate of the prepurified feed air passed into the cryogenic rectification plant.

FIGS. 1 and 2 illustrate preferred embodiments of the invention wherein all or most of the major streams leaving cryogenic rectification plant 7 pass not only through main heat exchanger 6 but also through prepurifier feed chiller 4. In these embodiments, heat exchangers 6 and 4 may be thought of as a two-part main heat exchanger with the prepurifier operating between the two parts of the main heat exchanger. The following example is presented for illustrative purposes and is not intended to be limiting. A computer simulation of the embodiment of the invention illustrated in FIG. 1 was carried out for the case where 86 percent of prepurified feed air flow is required for pressurized separated products thus leaving 14 percent of the prepurified feed air flow available for turboexpansion. The results are presented in Table 1. The numerals in Table 1 correspond to those of FIG. 1. In Table 1 the steam compositions are reported as the percent oxygen concentration. The remainder of the composition of each stream is primarily nitrogen.

TABLE 1

| Steam | Molar Flow % of 102 | Pressure PSIA | Temperature °F. | Composition % $O_2$ |
|---|---|---|---|---|
| 100 | 100.4 | 219 | 86 | 20.9 |
| 101 | 100.4 | 218 | 40 | 20.9 |
| 102 | 100.0 | 217 | 45 | 21.0 |
| 103 | 100.0 | 216.5 | −20 | 21.0 |
| 60 | 21.2 | 74.0 | −27.8 | 95.0 |
| 90 | 0.3 | 212 | −27.8 | 0.1 |
| 70 | 78.5 | 72.6 | −27.8 | 1.0 |
| 72 | 78.5 | 71.6 | 77.5 | 1.0 |
| 73 | 64.6 | 71.6 | 77.5 | 1.0 |
| 74 | 13.9 | 71.6 | 77.5 | 1.0 |
| 75 | 13.9 | 71.0 | 167.3 | 1.0 |
| 76 | 13.9 | 17.7 | −27.8 | 1.0 |
| 78 | 13.9 | 16.7 | 77.5 | 1.0 |
| 92 | 0.3 | 211 | 77.5 | 0.1 |
| 62 | 21.2 | 73.0 | 77.5 | 95.0 |

Now by the practice of this invention one can effectively integrate energy from a cryogenic rectification plant to process feed enabling effective prepurification of the feed while eliminating the need for a separate energy consuming mechanical feed air cooler or refrigerator. Although the invention has been described in detail with reference to certain preferred embodiments, those skilled in the art will recognize that there are other embodiments of the invention within the spirit and the scope of the claims.

I claim:

1. A method for carrying out cryogenic rectification comprising:

(A) cooling feed air and thereafter prepurifying the cooled feed air;

(B) passing prepurified feed air into a cryogenic rectification plant and separating the prepurified feed air within the cryogenic rectification plant into nitrogen-richer fluid and oxygen-richer fluid;

(C) withdrawing nitrogen-richer fluid from the cryogenic rectification plant and passing withdrawn nitrogen-richer fluid in indirect heat exchange with feed air for cooling the feed air prior to prepurification; and (D) turboexpanding at least a portion of the withdrawn nitrogen-richer fluid and passing turboexpanded nitrogen-richer fluid in indirect heat exchange with feed air for cooling the feed air prior to prepurification.

2. The method of claim 1 further comprising withdrawing oxygen-richer fluid from the cryogenic rectification plant and passing withdrawn oxygen-richer fluid in indirect heat exchange with feed air for cooling feed air prior to prepurification.

3. The method of claim 1 wherein the flowrate of the turboexpanded fluid passed in indirect heat exchange with feed air for cooling the feed air prior to prepurification comprises from 4 to 80 percent of the flowrate of the prepurified feed air passed into the cryogenic rectification plant.

4. The method of claim 1 further comprising recovering power from the turboexpansion.

5. The method of claim 1 further comprising cooling feed air after prepurification and passing the turboexpanded nitrogen-richer fluid in indirect heat exchange with feed air for cooling the feed air after prepurification prior to passing the turboexpanded nitrogen-richer fluid in indirect heat exchange with feed air for cooling the feed air prior to prepurification.

6. The method of claim 1 further comprising cooling feed air after the prepurification, turboexpanding another portion of the withdrawn nitrogen-richer fluid and passing said another portion of turboexpanded nitrogen-richer fluid in indirect heat exchange with feed air for cooling the feed air after prepurification.

7. Apparatus for carrying out cryogenic rectification comprising:

(A) a prepurifier feed chiller, a prepurifier, and means for passing feed through the prepurifier feed chiller and from the prepurifier feed chiller to the prepurifier;

(B) a cryogenic rectification plant and means for passing feed from the prepurifier into the cryogenic rectification plant;

(C) means for withdrawing fluid from the cryogenic rectification plant, and means for passing withdrawn fluid through said prepurifier feed chiller; and (D) a turboexpander, means for passing at least a portion of the withdrawn fluid through the turboexpander; and means for passing fluid from the turboexpander through said prepurifier feed chiller.

8. The apparatus of claim 7 further comprising a main heat exchanger wherein the means for passing feed from the prepurifier into the cryogenic rectification plant includes the main heat exchanger.

9. The apparatus of claim 8 wherein the means for passing fluid from the turboexpander through the prepurifier feed chiller passes through the main heat exchanger.

* * * * *